US005619950A

United States Patent [19]

Ikeda

[11] Patent Number: 5,619,950

[45] Date of Patent: Apr. 15, 1997

[54] WATERCRAFT

[75] Inventor: Keijiroh Ikeda, Shizuoka-ken, Japan

[73] Assignee: Yamaha Hatsudoki Kabushiki Kaisha, Iwata, Japan

[21] Appl. No.: 584,447

[22] Filed: Jan. 11, 1996

Related U.S. Application Data

[62] Division of Ser. No. 231,337, Apr. 22, 1994, Pat. No. 5,490,474.

[30] Foreign Application Priority Data

Apr. 27, 1993 [JP] Japan ..... 5-100954
Apr. 28, 1993 [JP] Japan ..... 5-103100

[51] Int. Cl.[6] ..... B63B 17/00

[52] U.S. Cl. ..... 114/363; 440/38; 440/89; 114/270

[58] Field of Search ..... 114/270, 343, 114/362, 363, 288, 289, 290, 291, 292; 440/38, 46, 88, 89

[56] References Cited

U.S. PATENT DOCUMENTS 4,055,140 10/1977 Kirchhan .
4,393,802 7/1983 Rizzo .
4,437,841 3/1984 Stallman .
4,688,508 8/1987 Nishida .
4,688,509 8/1987 Nishida .
4,738,642 4/1988 Koyama et al. .
4,924,797 5/1990 Solia .
4,982,682 1/1991 Hattori .
5,007,870 4/1991 Okubo et al. .
5,076,190 12/1991 Iikawa .
5,096,446 3/1992 Tazaki et al. .
5,163,394 11/1992 Koishikawa et al. .
5,199,913 4/1993 Toyohara et al. .
5,255,626 10/1993 Hattori et al. .

FOREIGN PATENT DOCUMENTS 62-125989 6/1987 Japan .

*Primary Examiner*—Stephen Avila
*Attorney, Agent, or Firm*—Knobbe, Martens, Olson & Bear LLP

[57] ABSTRACT

A small personal watercraft having a number of features, such as a pair of rear-view mirrors which form a ventilating function for ventilating the engine compartment. The watercraft has a straddle-type motorcycle-like seat on which passengers may sit in straddle/tandem fashion and an engine. The major portions of its exhaust system are disposed beneath this seat. The exhaust system is centralized in the watercraft to maintain side-to-side balance, and a portion of the seat is removable for accessing the engine. Various grab-handle arrangements are also incorporated for assisting riders to maintain their stability or for assisting in entry of the watercraft from the body of water in which the watercraft is operated using a foldable ladder mounted on a rear deck to the rear of the seat.

11 Claims, 16 Drawing Sheets

WATERCRAFT

This application is a divisional of U.S. patent application Ser. No. 08/231,337, filed Apr. 22, 1994 now U.S. Pat. No. 5,490,474.

BACKGROUND OF THE INVENTION

This invention relates to a watercraft and more particularly to several improved features of watercraft.

Many of the small personal type watercraft employ a seat that accommodates the rider and possibly additional passengers seated in straddle fashion and when plural riders are accommodated they are seated in tandem fashion. This requires a provision of a pair of relatively low foot areas so that the riders can be seated comfortably and this reduces the area in which the engine, propulsion unit and exhaust system can be employed. In order to accommodate this situation, it has been proposed to mount the engine either entirely or partially and/or the propulsion unit and/or the transmission which connects the engine to the propulsion unit all or partially beneath the seat. This gives rise to difficulties to accessing and servicing those components which are disposed beneath the seat. Although it has been proposed to provide a completely detachable seat, the seat structure is generally heavy and cumbersome in and or itself. The problem becomes more acute when the length of the seat cushion is extended either to accommodate a rider sitting in different positions on the seat or where the seat is arranged so as to accommodate plural riders seated in tandem fashion.

It is, therefore, a principle object of this invention to provide an improved watercraft hull assembly of this general type wherein portions of the watercraft propulsion system are disposed beneath the seat and are accessible by means of a removable seat cushion portion which forms only a portion of the total seat.

As has been noted, the small personal watercraft of the type described normally employ a seating arrangement wherein the rider and possibly one or more passengers are seated in straddle fashion. Where this is done and where plural riders are accommodated, it is advantageous if the rear rider can have his head positioned slightly above that of the forward rider. In this way, the rear rider has the forward view. However, due to the small nature of these watercraft, this means that the rear positioned rider has nothing to grip in order to steady himself.

It is, therefore, a further principal object of this invention to provide a seating arrangement for a small watercraft wherein a pair of handles can be easily provided at the rear of the seat.

The type of watercraft described and particularly most personal type of watercraft generally have a passenger's area that opens through the transom of the watercraft so that the watercraft can be boarded from the body of water in which the watercraft is operating. However, it is desirable to provide some means to assist the passenger to enter the watercraft.

It is, therefore a still further object of this invention to provide an improved grab handle arrangement for the rear portion of a small watercraft for assisting entry of the watercraft at the rear from the body of water in which the watercraft is operating.

SUMMARY OF THE INVENTION

An important feature of this invention is adapted to be embodied in a watercraft that is comprised of a hull and which hull forms a rider's area. The rider's area includes an elevated seating portion for accommodating a rider seated thereon in a straddle posture. A pair of foot areas are disposed in the rider's area on opposite sides of the elevated seat portion to receive the feet of the rider seated thereon. A propulsion system for the hull is contained at least in part therein. This propulsion system is comprised of a propulsion device for propelling the hull, an internal combustion engine and a transmission for driving the propulsion device from the internal combustion engine. The upper surface of the elevated seating portion defines an access opening therein. For which at least a portion of the propulsion system may be accessed. A seat is carried at least in major part by the upper surface for accommodating the rider. The seat is comprised of a first portion that is affixed to the elevated portion and a second portion that is readily detachably connected to the elevated seating portion and which overlies the access opening.

DETAILED DESCRIPTION OF THE PREFERRED EMBODIMENT OF THE INVENTION

Figure 1:
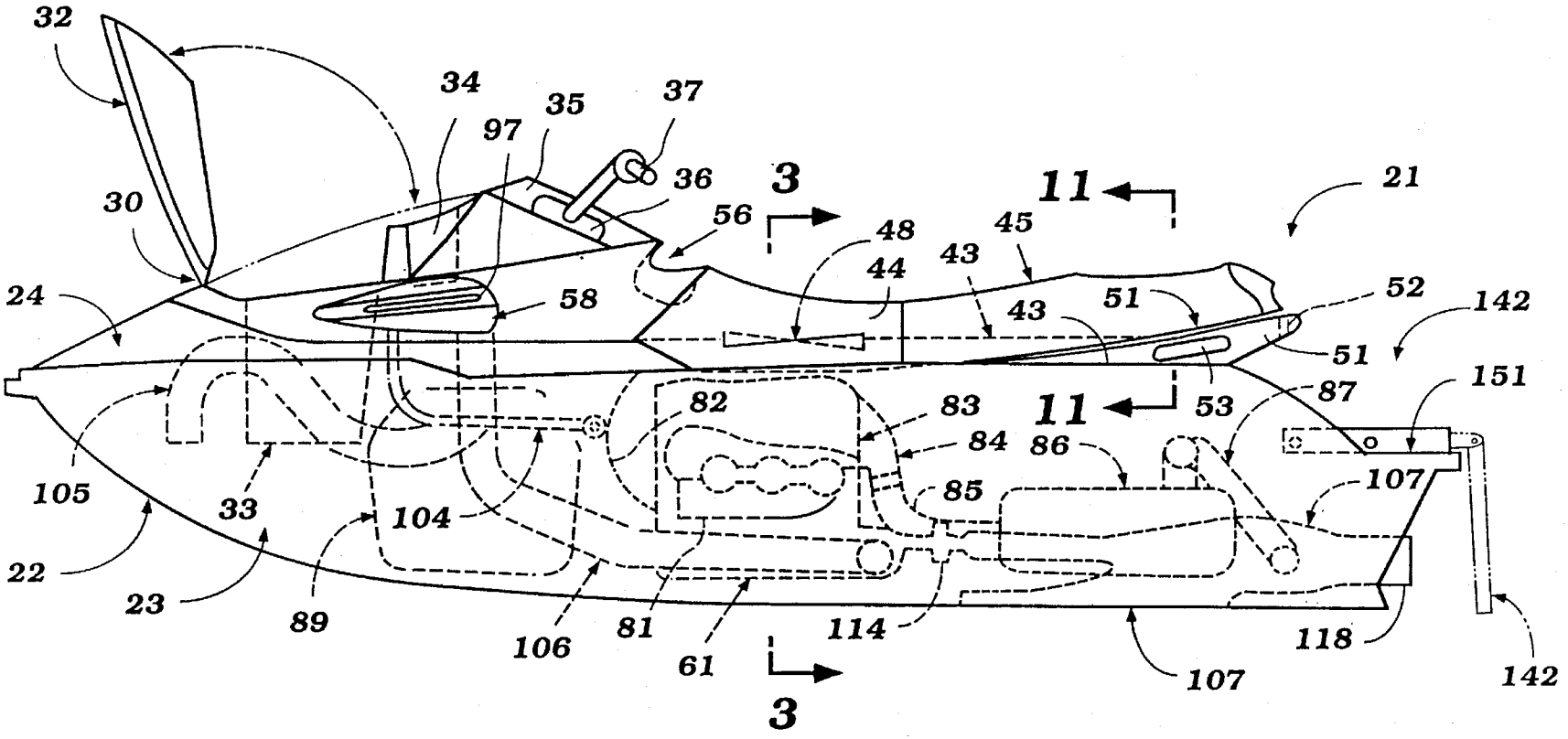
FIG. 1 is a side elevational view of a small watercraft constructed in accordance with an embodiment of the invention, showing the hatch cover in an open position in solid lines and in a closed position in phantom lines and the boarding ladder in its storage position in solid lines and in its boarding condition in phantom.
Figure 2:
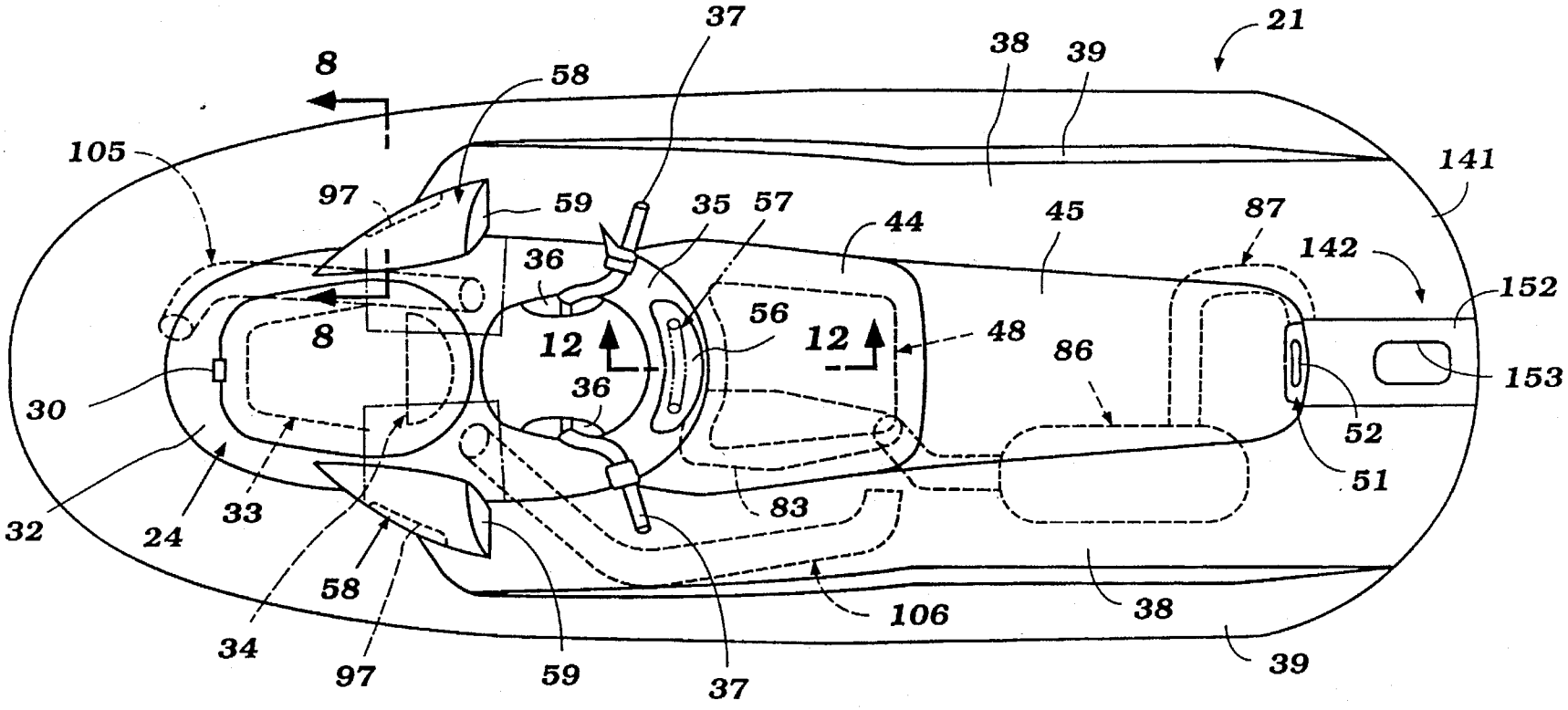
FIG. 2 is a top plan view of the watercraft.
Figure 3:
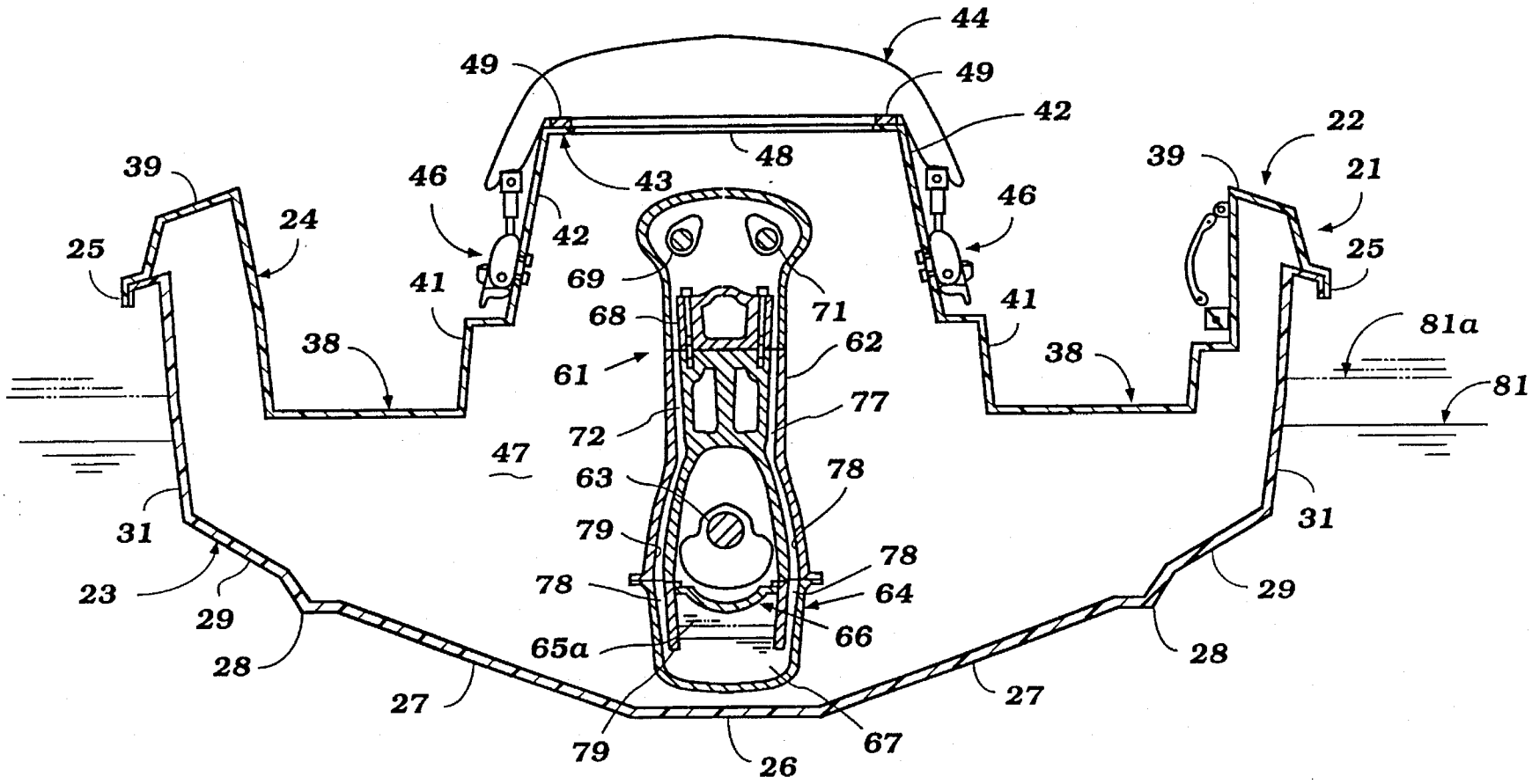
FIG. 3 is a transverse cross-sectional view taken generally along the line 3—3 of FIG. 1 on an enlarged scale and shows the water and oil levels in solid lines when the watercraft is floating in a normal condition and in phantom lines when the watercraft is fully inverted.

Referring now in detail to the drawings and initially primarily to FIGS. 1–3, a small watercraft constructed in accordance with an embodiment of the invention is identified generally by the reference numeral 21. The watercraft 21 is depicted as being of a type known as a personal watercraft in that it is designed to be operated by primarily a single rider, although it can accommodate additional riders, as will become apparent. Also, the personal watercraft 21 is very sporting in nature, and thus is normally operated and ridden by persons wearing swimming suits. As will become apparent, the watercraft 21 is designed so as to facilitate entry of the watercraft 21 from a person in the body of water in which the watercraft is operated. Although the invention is described in conjunction with such watercraft, it will be readily apparent to those skilled in the art that certain facets of the invention may be employed in other types of watercraft.

The watercraft 21 is comprised of a hull assembly, indicated generally by the reference numeral 22 and which is comprised of a lower hull portion 23 and an upper deck portion 24. The hull and deck portions 23 and 24 are formed from any suitable material, such as a molded fiberglass reinforced plastic or the like. Conveniently, the hull and deck portions 23 and 24 may be single-piece assemblies and are provided with overlapping flanges 25 at their outer periphery, which are affixed to each other in any suitable manner such as by bonding, welding, or the like.

The hull 22 is of the planing type and is comprised of a generally flat central section 26 that extends rearwardly from a point rearwardly of the bow and that merges into a pair V-shaped sections 27 that taper gradually outwardly sidewardly and that terminate in respective chines 28, which are joined to further tapered sections 29 that lie at a slightly different angle than the sections 27 and that merge into vertically extending sides 31, which terminate at gunnels at their upper end formed by the overlapping flanges 25 between the hull portion 23 and the deck portion 24.

The front of the deck 24 is provided with a hatch opening that is closed by a hatch cover 32, which is shown in its open position in FIG. 1 and in a closed position in phantom lines, by a hinge 30 at its forward edge. Disposed beneath the hatch cover 32 are a pair of spaced-apart storage compartments 33 and 34, with the forward storage compartment 33 being deeper and wider than the rearward storage compartment 34.

Rearwardly of the hatch cover 32, the deck 24 is provided with a raised control area 35 on which a steering mast (not shown) is journalled and which has a pair of slots 26 through which a pair of handlebars 37 for steering of the watercraft in a manner that will be described. The control portion 35 of the deck 24 forms part of the forward area of a passenger's area for the watercraft. This passenger's area is defined by a pair of foot areas 38, which extend inwardly from a pair of raised gunnels 39 formed by the deck portion 24 at the upper ends of the side walls 31 of the hull portion 23. These foot areas 38 extend forwardly beyond the control area 35 so that a forwardly positioned rider may place his feet forwardly of the handlebar assembly 37.

As may be best seen in FIG. 3, the area in the passenger's or rider's compartment between the foot areas 38 has a raised seat-supporting portion that is comprised of a first lower part 41 that extends generally vertically and an upper portion 42 that tapers slightly inwardly and that terminates at a horizontally extending portion 43. A seat cushion assembly comprised of a first, forward part 44 and a second rearward portion 45 is supported on the raised deck portion 43. The forward seat cushion portion 44 is detachably connected to the part 42 of the deck portion 24 by means of a pair of clamp-type fasteners 46, so as to permit access to an engine compartment 47 formed between the hull and deck portions 23 and 24 through an access opening 48 formed in the deck portion 43. A sealing gasket 49 is interposed around the opening 58 between the deck portion 43 and the underside of the seat 44 for sealing purposes.

Figure 10:
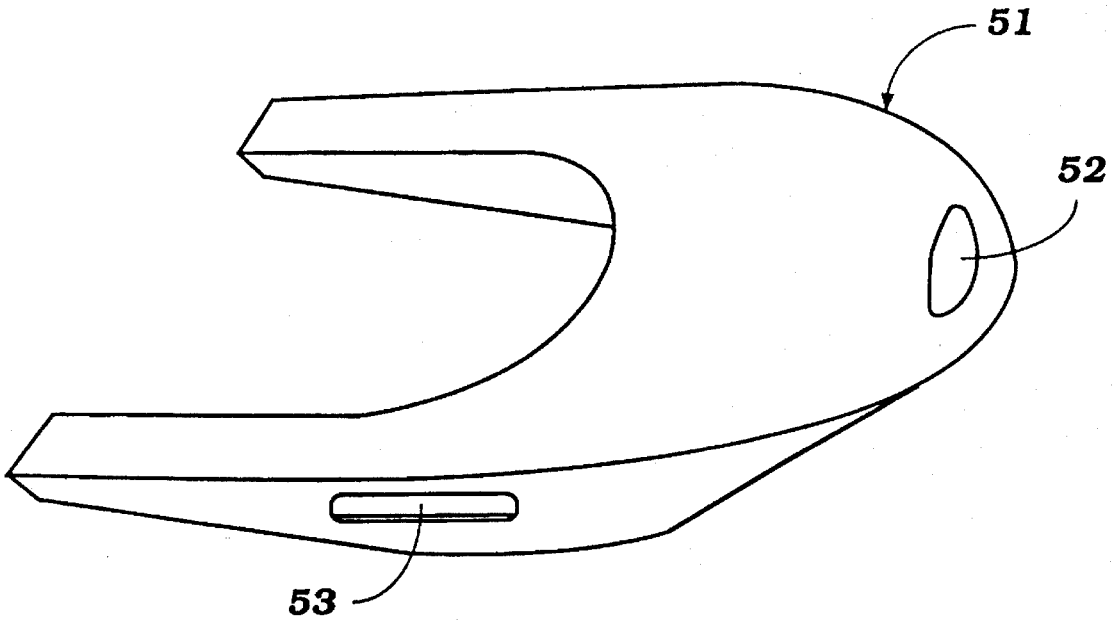
FIG. 10 is a perspective view of the rear seat insert forming the grab handles.
Figure 11:
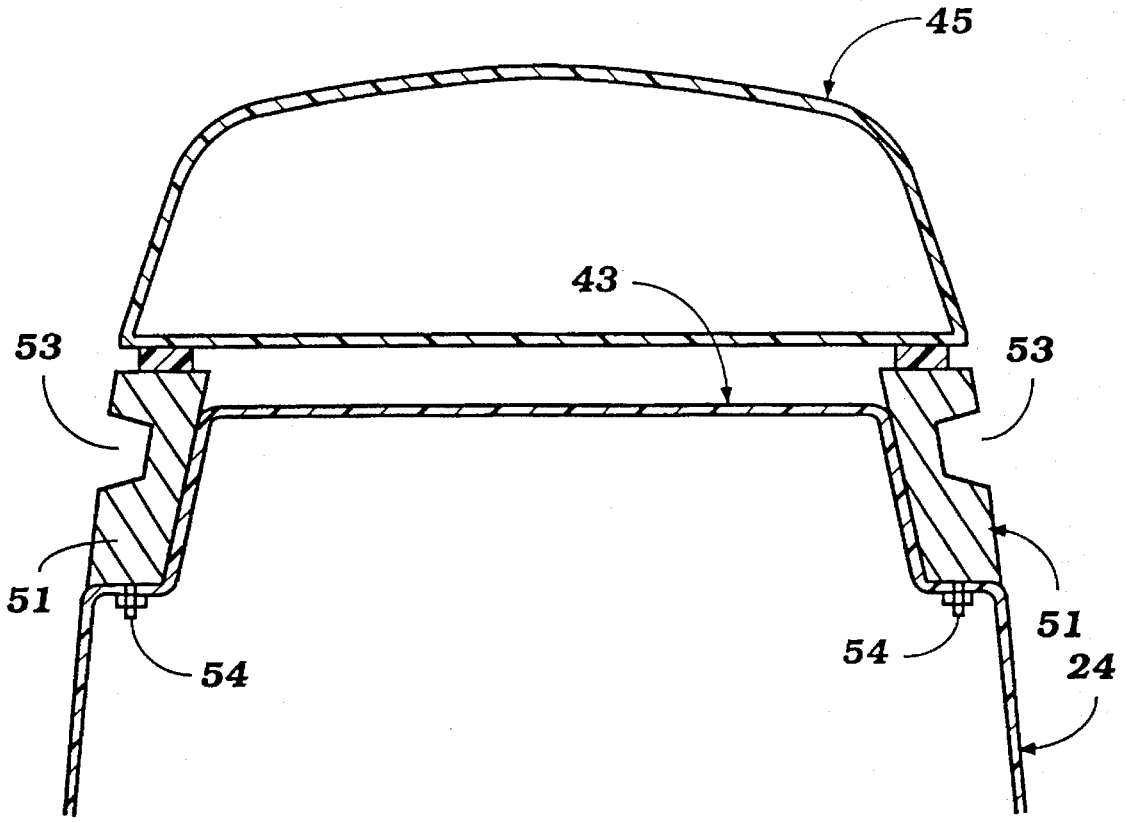
FIG. 11 is an enlarged cross-sectional area taken along the line 11—11 in FIG. 1 and shows how the insert of FIG. 10 cooperates with the body of the watercraft in the seat cushion.

The rear seat cushion portion 45 can be more permanently affixed to the deck portion 24, although it should be noted that the rear part of the rear seat cushion 45 is elevated above the deck portion 43 so that a rider will sit slightly higher than the forwardly positioned operator. An insert piece, indicated generally by the reference numeral 51 and having a construction as best shown in FIG. 10, is interposed between this raised portion of the rear seat cushion 45 and the deck portion 43. The member 51 may be formed from a suitable lightweight material and is provided with a rear handle opening 52 and a pair of side grip openings 53. The rear hand opening 52 is utilized to assist in boarding of the watercraft 21 in a manner that will be described. The forward hand grip portions 53 are adapted to receive the hands of a rider seated on the rear seat cushion 45 so as to maintain his stability. As may be best seen in FIG. 11, the insert piece 51 is held in place by means of threaded fasteners 54.

Figure 12:
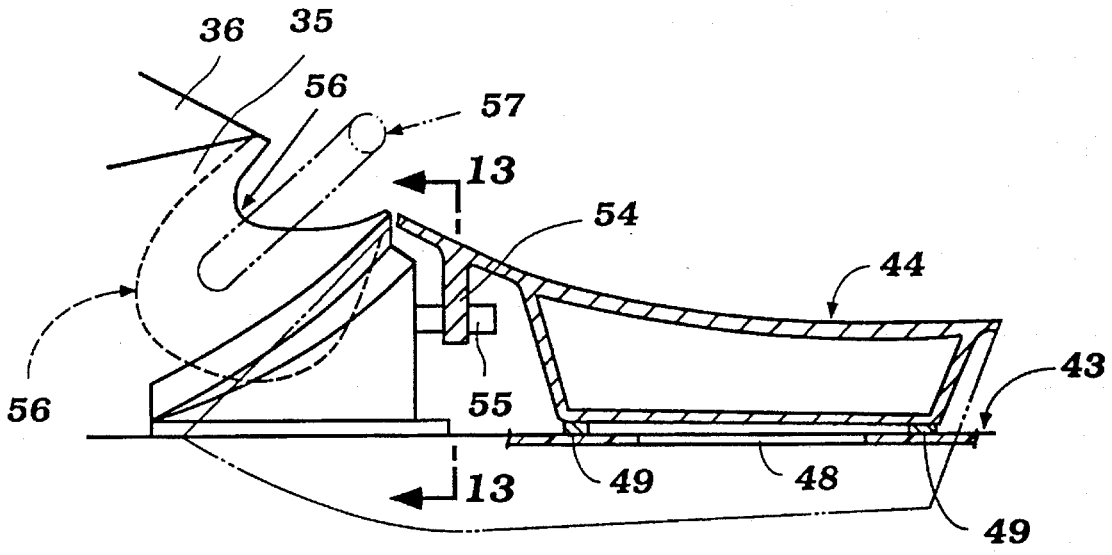
FIG. 12 is an enlarged cross-sectional view taken along the lines 12—12 of FIG. 2.
Figure 13:
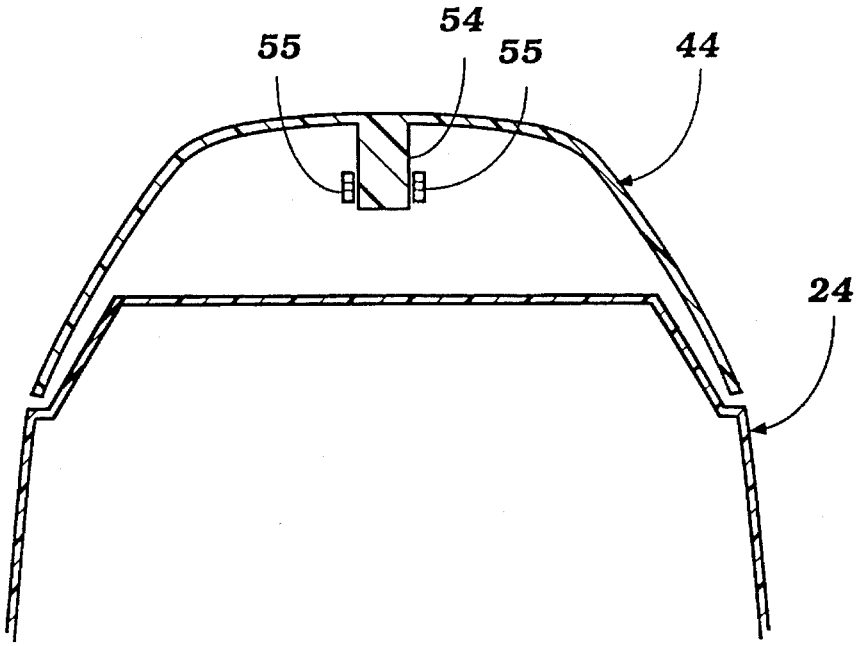
FIG. 13 is a cross-sectional view taken along the line 13—13 of FIG. 12.
Figure 14:
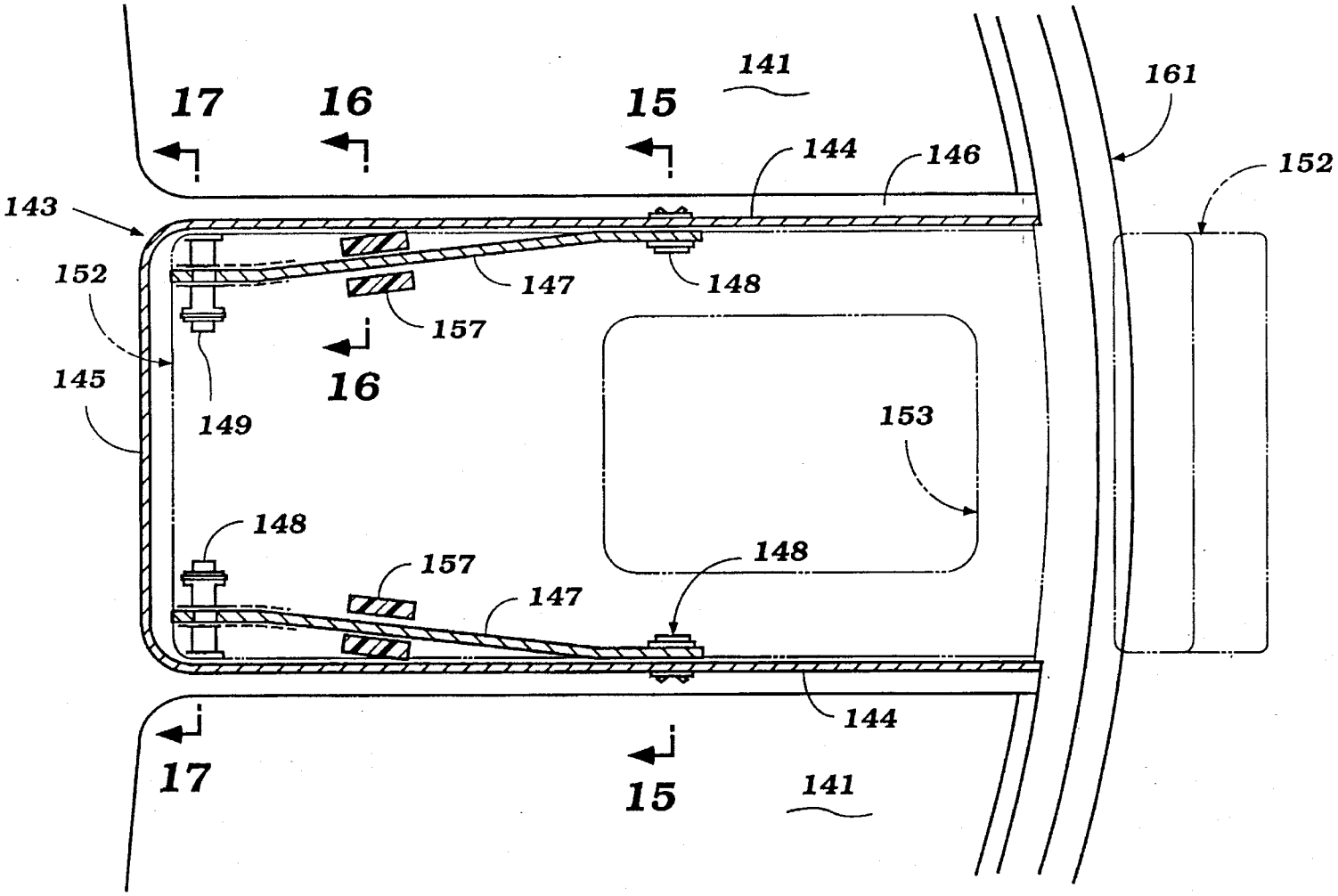
FIG. 14 is a cross-sectional view taken through the supporting structure for the boarding ladder and shows a portion of the boarding ladder in phantom.
Figure 15:
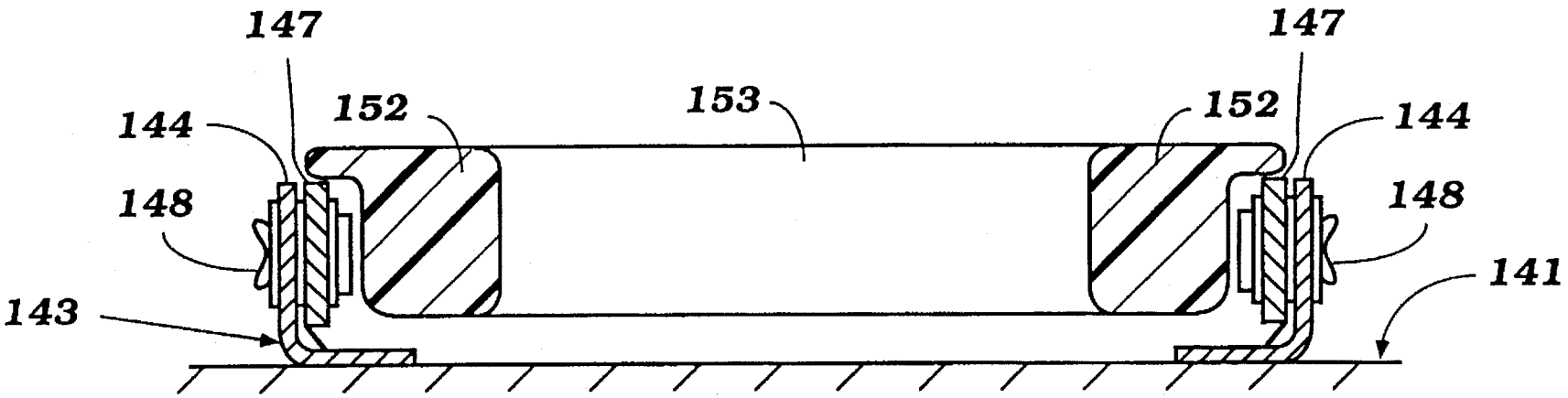
FIG. 15 is an enlarged cross-sectional view taken along line 15—15 of FIG. 14.
Figure 16:
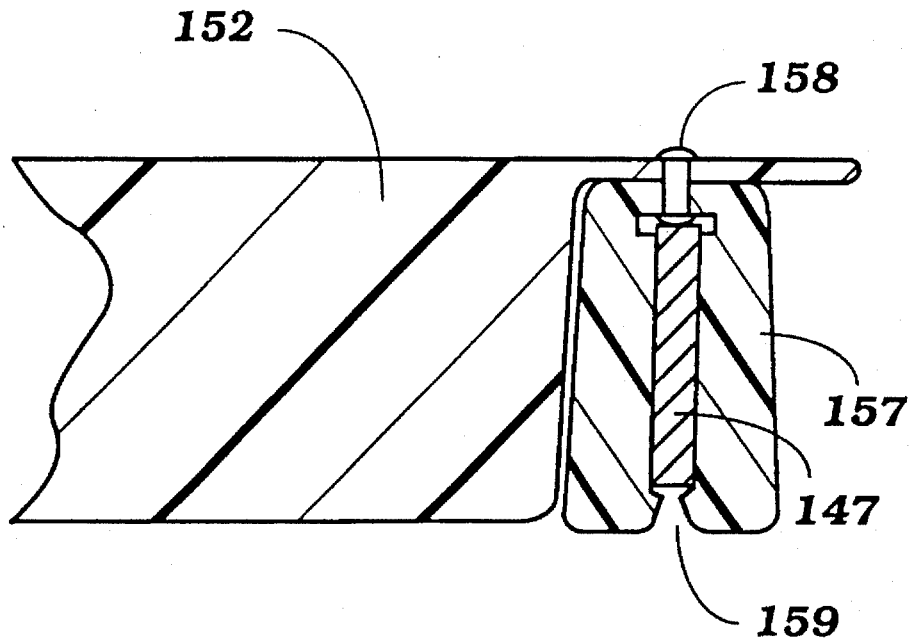
FIG. 16 is an enlarged cross-sectional view taken along the line 16—16 of FIG. 14.
Figure 17:
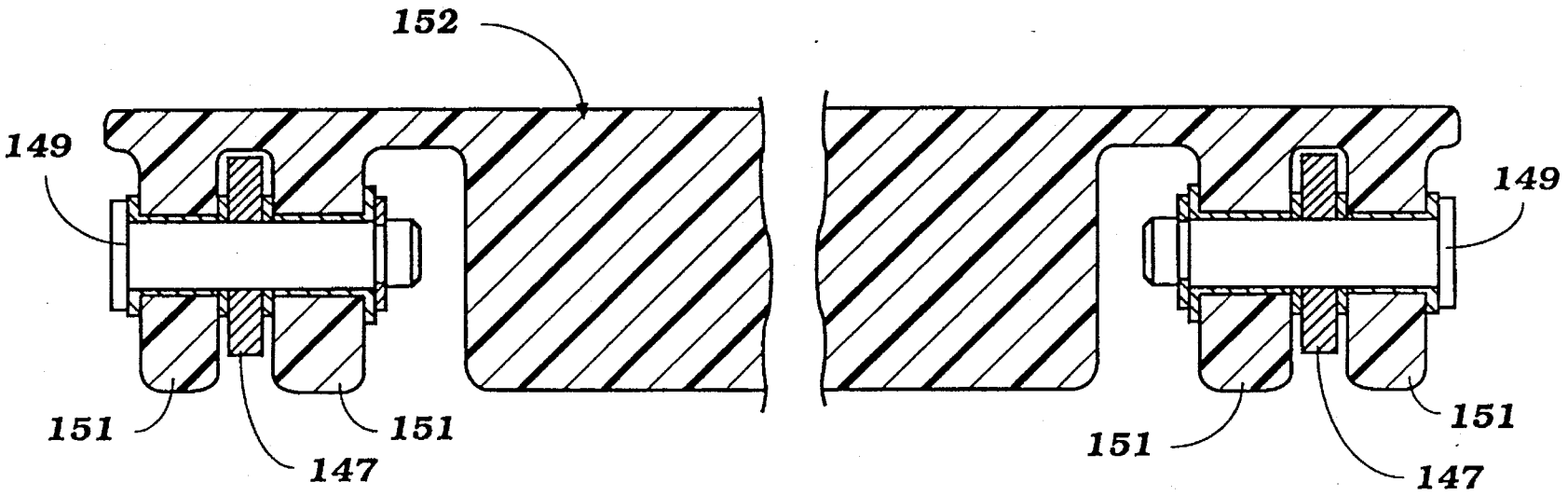
FIG. 17 is an enlarged cross-sectional view taken along the line 17—17 of FIG. 14.

As may be seen in FIGS. 12 and 13, the forward part of the forward seat cushion 44 is provided with a downwardly extending projection 54 that is received between a pair of locating lugs 55 that extend rearwardly from the control area 35 so as to assist in locating the forward seat cushion 44 when it is removed and reinstalled for access to the engine compartment through the opening 48. It should be noted that the area forwardly of the front seat cushion 44 below the control area 35 is provided with a recess 56 in which a grab handle 57 is affixed. The grab handle 57 permits a child or small person to be seated forwardly of the operator on the front seat cushion 44 and still be able to maintain his stability without grabbing the handle bars 37.

A pair of rear-view mirror assemblies, indicated generally by the reference numeral 58, are mounted on the sides of the control portion 35 and at the forward ends of the foot areas 38. These mirror assemblies 58 include rear-view mirrors 59 so as to permit the operator to have a view of what is following him. In addition, the mirror assemblies 58 provide a ventilating function for the engine compartment 47, as will be described later.

Because of the provision of the raised area 43 to accommodate the seat cushions 44 and 45, the area beneath the seats is quite high. This permits a central placement of an internal combustion engine, indicated generally by the reference numeral 61. In accordance with a feature of the invention, the engine 61 is of the in-line type and includes a cylinder block 62, in which a plurality of cylinder bores are formed. Since the basic internal construction of the engine, except for a feature with respect to its lubricating system, forms no part of the invention, the details of the portions of the engine 61, which are not relevant to the inventive portion, have not been illustrated, and only the general arrangement for the engine 61 will be described.

Therefore, the pistons, which reciprocate in the cylinder bores, are not shown, nor are the connecting rods but these are connected in a well-known manner to a crankshaft 63 that is rotatably journalled within a crankcase assembly formed by the skirt of the cylinder block 62 and a crankcase member 64 that is detachably connected to the cylinder block 62 in a well-known manner. A quantity of lubricant 67 which has a normal level, indicated by the line 65, is maintained in the crankcase chamber and is circulated throughout the engine for its lubrication in any well-known manner. A baffle plate 66 is disposed between the crankshaft 63 and the lubricant level 65 of the lubricant body 67, so as to prevent the lubricant from being whipped or churned by the crankshaft 63. Suitable openings are formed along the length of the baffle plate 66 so that lubricant can easily drain back into the crankcase 64.

A cylinder head assembly 68 is affixed to the cylinder block 62 in a known manner and contains the valve mechanism, including a pair of overhead cam shafts 69 and 71, which are driven in a known manner by the crankshaft 63.

Lubricant is delivered to the valve train, including the cam shafts 69 and 71, by the lubricating system of the engine. This lubricant is then drained back to the crankcase chamber by drain passages 72 formed in the cylinder block and which communicate with further drain passages 78 formed in the crankcase member 64. It should be noted that the passages 78 terminate at lower ends 79, which is below the normal lubricant level 65 and close to the bottom of the crankcase member 64. A reason for this is to ensure that the amount of lubricant which may drain to the camshaft mechanism in the cylinder head 68 if the watercraft becomes inverted will not completely deplete the lubricant in the crankcase 64.

In FIG. 3, the normal upright water level is indicated by the line 81. The line 81*a* indicates the water level when the watercraft 22 is completely inverted. When this occurs, lubricant will drain into the cam cover only until the point when the lower (upper when inverted) ends 79 of the passages 78 are reached. Then the remaining lubricant will be trapped in the crankcase chamber, as indicated by the line 65*a* in this figure. In order to further ensure against drainage back, there may also be provided check valves 79 in the passages 77, which permit lubricant to flow down into the crankcase chamber 64 but not up out of it when the watercraft is inverted. If the watercraft is of the type which self-rights, these check valves may not be required, but they can be employed to minimize the amount of lubricant which does flow back to the cam chamber when the watercraft 22 is inverted, even temporarily.

Aside from the lubrication system as thus far described, other internal details of the engine 61 may be considered to be conventional, and for that reason they are not illustrated.

Another feature associated with the engine 61, which is relevant and which embodies a feature of the invention, is the exhaust system for the engine 61. This exhaust system includes an exhaust manifold 81 that receives the exhaust gases from the exhaust ports in the cylinder head 68 and transfers them through a C-shaped pipe section 82 to an expansion chamber device 83, which is disposed at one side of the engine 61 and relatively high in the engine compartment 47. This expansion chamber is disposed entirely beneath the seat cushion 44, and hence is disposed quite close to the longitudinal centerline of the watercraft. In addition, the expansion chamber 83, which may be rather heavy, also can be located fore and aft at about the midpoint of the watercraft 21, and thus maintain good balance. This is possible because of the raised seat cushions 44 and 45 and the elevated deck portions 41 and 42.

The expansion chamber device 83 has an outlet portion 84, which communicates with an exhaust pipe 85, which, in turn, delivers the exhaust gases to a water trap device 86. The water trap device 86, as is well-known in the marine art, is designed so as to permit the exhaust gases to exit and be discharged to the atmosphere in a location to be described while precluding water from entering the engine through the exhaust system. It will be noted from FIG. 2 that the water trap device 86, although being positioned below the level of the floorboards 38, is positioned in substantial part beneath the rear seat cushion portion 45, and thus permits the side to side balance of the watercraft to be maintained.

An exhaust outlet pipe 87 extends from the water trap device 86 into a tunnel area 88 formed on the underside of the hull portion 23 immediately behind the flat area 26. This exhaust pipe end 87 may be disposed slightly beneath the water level if desired, so that the underwater exhaust gas discharge will assist in the silencing of the exhaust gases. As has been previously noted, the water trap device 86 will preclude water from entering the engine through the exhaust system.

A fuel tank 89 (FIG. 1) for containing fuel for the engine 61 is positioned in the engine compartment 47 forwardly of the engine 61. Like the other heavy components of the watercraft, the fuel tank 89 is disposed substantially along the longitudinal centerline of the watercraft so as to maintain side-to-side balance. In this regard, it should be noted that the steps 28 of the hull are disposed well outside of these weighty components of the watercraft and outwardly of the foot areas 36 so as to further maintain the stability of the watercraft.

Figure 8:
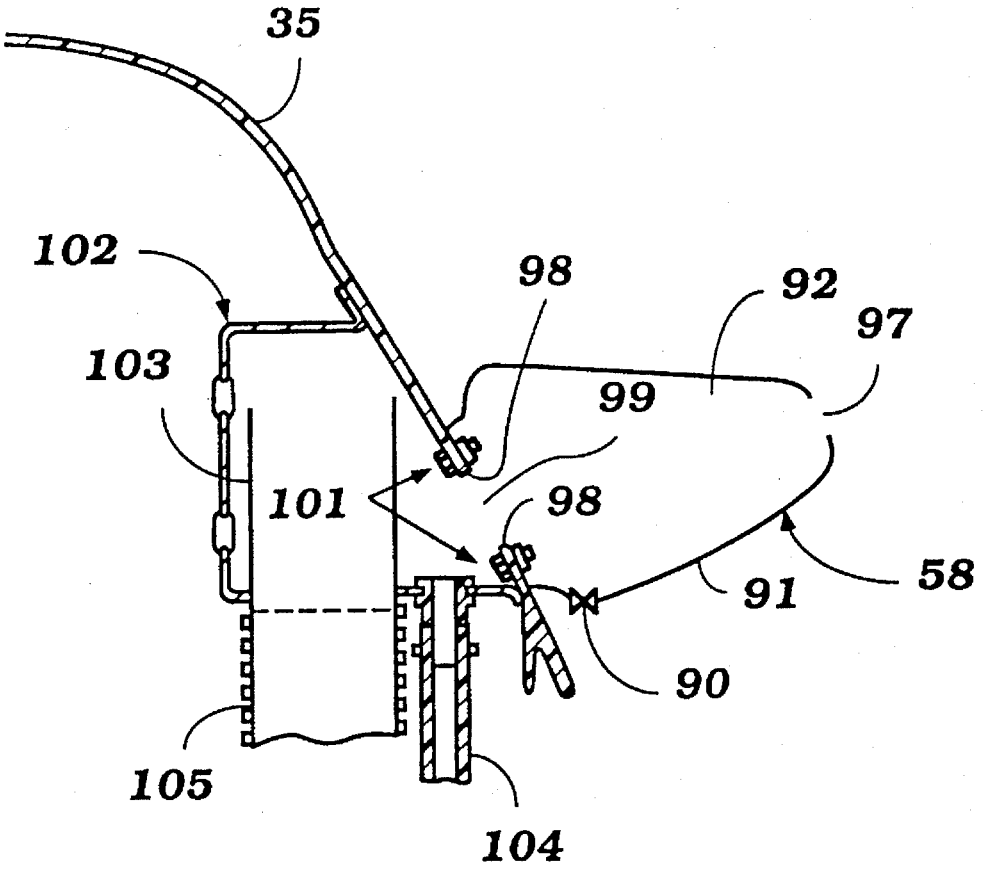
FIG. 8 is an enlarged cross-sectional view taken along the line 8—8 of FIG. 2 and shows the engine compartment ventilating system and associated rear view mirror.
Figure 9:
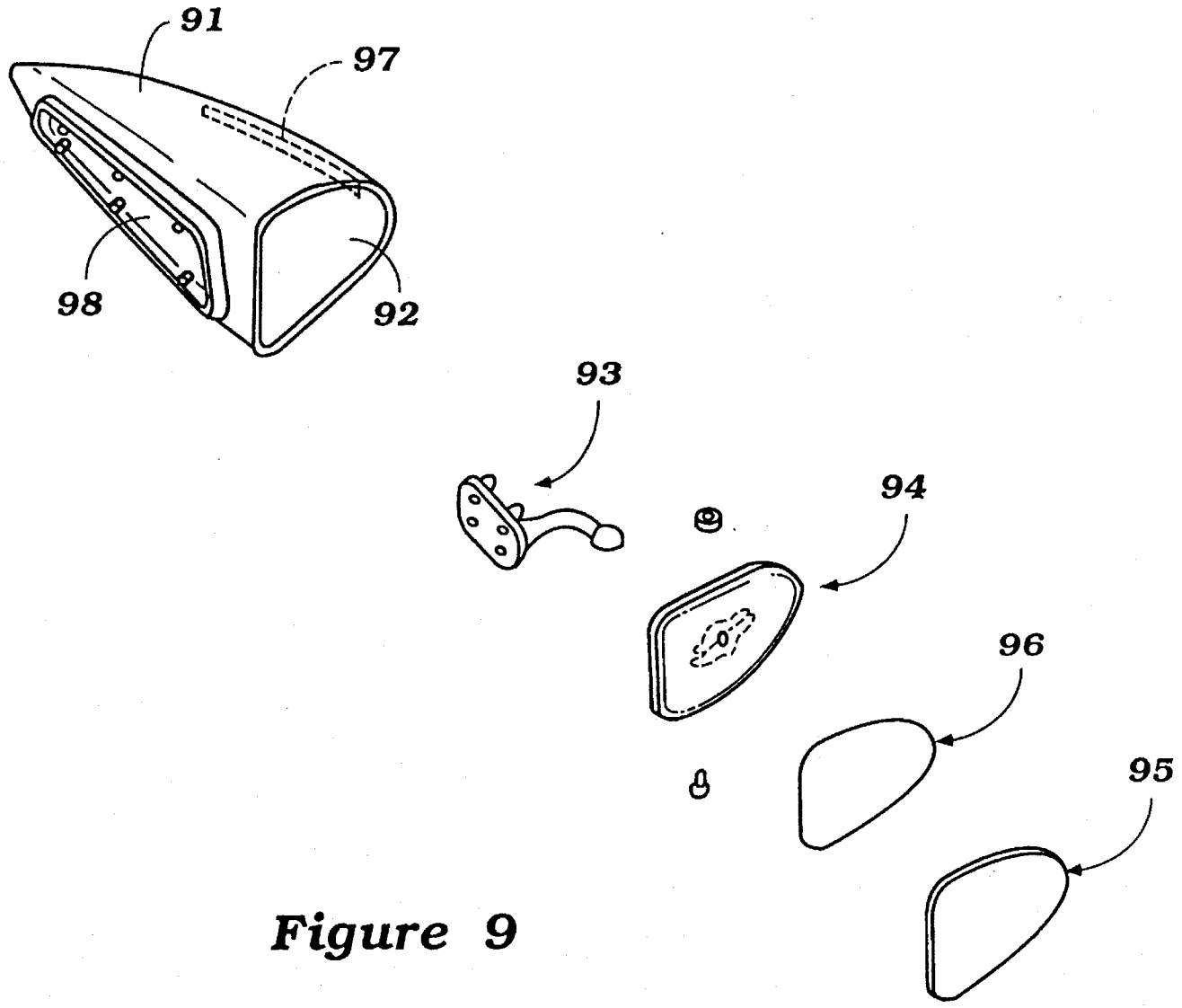
FIG. 9 is an exploded perspective view of the rear view mirror.

It has already been noted that it is desirable to maintain good ventilation in the engine compartment 47, not only to supply air for the operation of the engine 61 but also to provide ventilation so that any fumes in the engine compartment can be ventilated. As has been previously noted, the mirror assemblies 58 cooperate in this ventilating function, and how this is done will now be described by particular reference to FIGS. 1, 2, 8, and 9 with FIGS. 8 and 9 showing in most detail the construction of the mirror assemblies 58. The mirror assemblies 58 are comprised of an outer housing 91 having an opening 92 at its rear end. A mounting bracket 93 is supported in the housing 91 and has a universal connection to a backing plate 94, to which a mirror 95 is affixed by an adhesive pad 96.

To provide the ventilating function, each mirror housing 91 is provided with a forwardly facing air inlet slot 97, which permits air to be drawn inwardly, particularly due to a ram action, which will occur when the watercraft 21 is operating in a forward direction. The air then flows through an opening 98 formed in the housing 91, which registers with a corresponding opening 99 formed in the deck control portion 35. The mirror housing 91 is affixed to the deck portion 35 by threaded fasteners 101.

A plenum box 102 is affixed to the inside of the deck portion 35 and has a ventilating duct 103 that extends vertically upwardly into the plenum box 102 and downwardly beyond it. The vertical upward extent of the ventilating duct 103 will provide a function to separate water that may be drawn through the ventilating system thus far described from entering into the engine compartment 47. A drain pipe 104 carries any condensed water downwardly and may discharge the water overboard through suitable openings formed in the hull portion 23. Alternatively, the drain pipes 104 may communicate with the bilge of the watercraft where they will be pumped out by a bilge pump if one is provided.

The housing 91 also has a drain opening 90 which may be provided with a check valve so that any water trapped in the housing 91 may drain out rather than into the plenum box 102.

The ventilating construction as thus far described is the same for each side of the watercraft. At one side (the right-hand side) a flexible conduit 105 is connected to the ventilating duct 103 and extends forwardly to the forward-most portion of the engine compartment 47. At the other (left-hand side) side a flexible pipe 106 is connected to the ventilating duct 103 and discharges into proximity with the engine 61, as clearly shown in FIGS. 1 and 2. Hence, there is a good distribution of ventilating air throughout the entire engine compartment 47. Any suitable atmospheric discharge for this air may be provided.

As has been noted, a tunnel 88 is provided centrally at the rear under surface of the lower hull portion 23. This tunnel houses a jet propulsion unit, indicated generally by the reference numeral 107, and the construction by which the jet propulsion unit 107 is mounted, and the description of the jet propulsion unit 107 will be made by reference primarily to FIGS. 1 and 5–7. It may be seen in these figures that the tunnel 88 is defined by a wall 108 of the under hull 23, which, as has been noted, is disposed to the rear of the flattened section 26, and the under surface of it may be considered to be an extension thereof, as will be described.

The jet propulsion unit 107 is comprised of an outer housing assembly having a first water inlet duct-forming portion 109 that terminates in a downwardly facing water inlet opening 111. Water is supplied to this opening 111 in a manner that will be described. The inlet duct-forming portion 109 has a forwardly extending tubular portion, 112 through which an impeller shaft 113 passes. This impeller shaft 113 is connected by means of a flexible coupling 114 (FIG. 1) to the crankshaft 63 of the engine 61 in a well-known manner.

The water is drawn through the inlet opening 111 and through an inlet channel 115 by an impeller 116 that is affixed for rotation with the impeller shaft 113. The impeller shaft 113 is journalled in the outer housing in any known manner.

The water thus pumped is discharged through a discharge nozzle portion 117, after having passed through straightening vanes (not shown), and then through a steering nozzle 118. The steering nozzle is supported for steering movement about a vertically extending steering axis 119 and is coupled to the handlebar assembly 37 for steering of the watercraft in a well-known manner. A reverse thrust bucket assembly, indicated generally by the reference numeral 121, may be carried in a suitable manner on the steering nozzle 118 and operated by a remote lever or control in proximity to the handlebar control 36.

Figure 4:
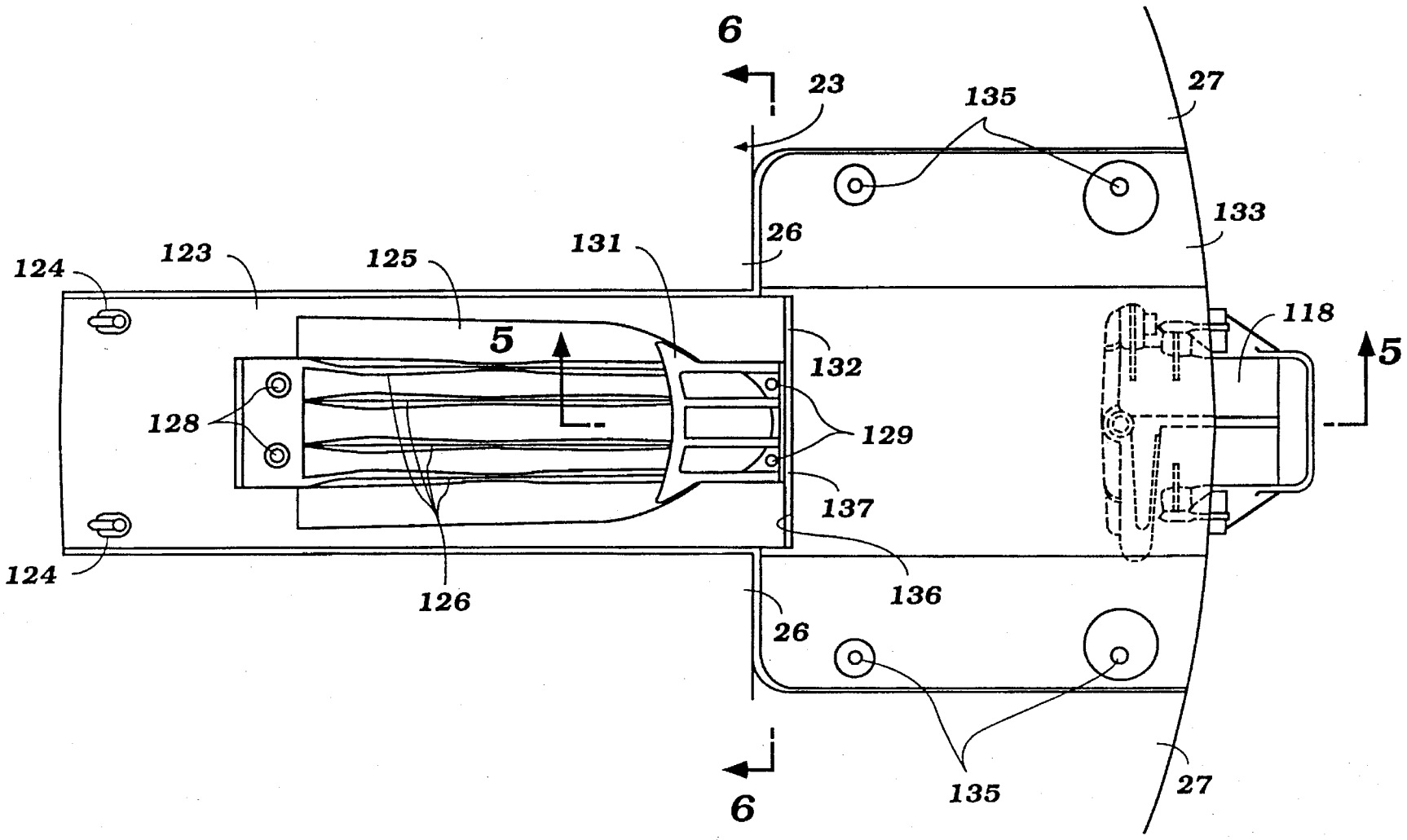
FIG. 4 is an enlarged bottom plan view showing the rear portion of the watercraft in the area where the jet propulsion unit is mounted.

The forward portion of the tunnel is partially closed by a closure plate 123, which is affixed to the hull forwardly of the tunnel by a pair of fasteners 124. The rear support for the plate 123 will be described later. A separate grill-forming portion 125 having slats 126 defines a water inlet opening 127, which registers with the water inlet opening 111 of the jet propulsion unit so that water may enter the jet propulsion unit. The plate 123 provides a smooth hull under-surface, and the slats 126 will ensure that large foreign objects will not be drawn into the jet propulsion unit 107. The inlet-forming member 125 is affixed to the plate 123 at its forward end by fasteners 128. At the rear end, the inlet-forming member 125 is affixed to the plate 123 and also to the hull portion 23 by fasteners 129. The inlet forming member 125 has an upwardly extending projection 131, which engages the duct-forming portion 109 of the jet propulsion unit 107 and provides forward support for it. The rear of the duct-forming member 125 and plate 123 defines a vertically extending edge 132, as shown best in FIGS. 4 and 5.

The tunnel 88 may be slightly wider at its rearward end, and this rearward end is closed by a further closure plate 133, which underlies the tunnel 88 and which extends laterally outwardly into a pair of recesses 134 formed on the hull under-surface rearwardly of the edge 132. Threaded fasteners 135 extend through the outwardly extending portions of the plate 133 and affix the under plate 133 in underlying relationship to the rear of the jet propulsion unit 107 and close the rear portion of the tunnel 88.

Figure 5:
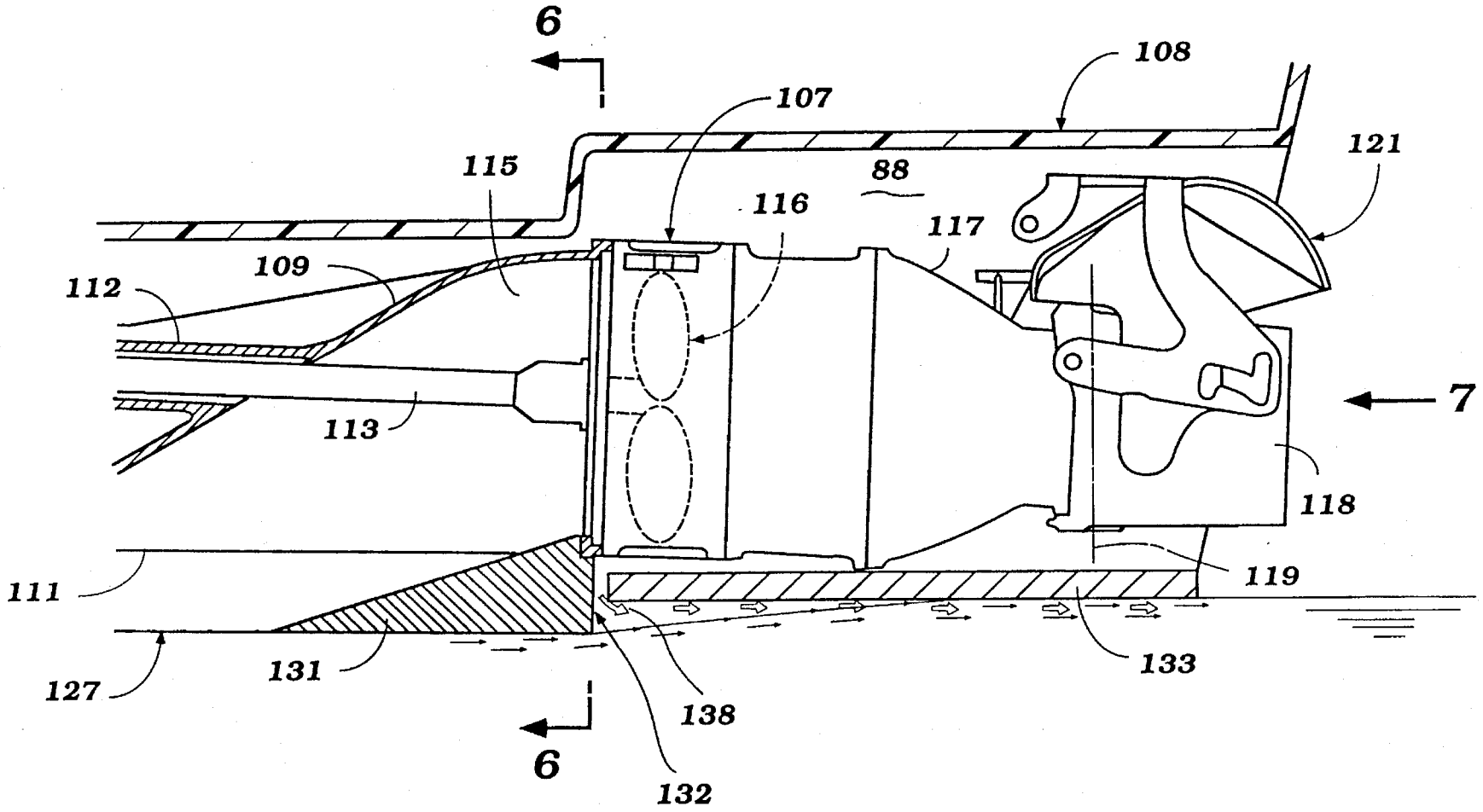
FIG. 5 is an enlarged cross-sectional view taken along the lines 5—5 of FIG. 4.
Figure 6:
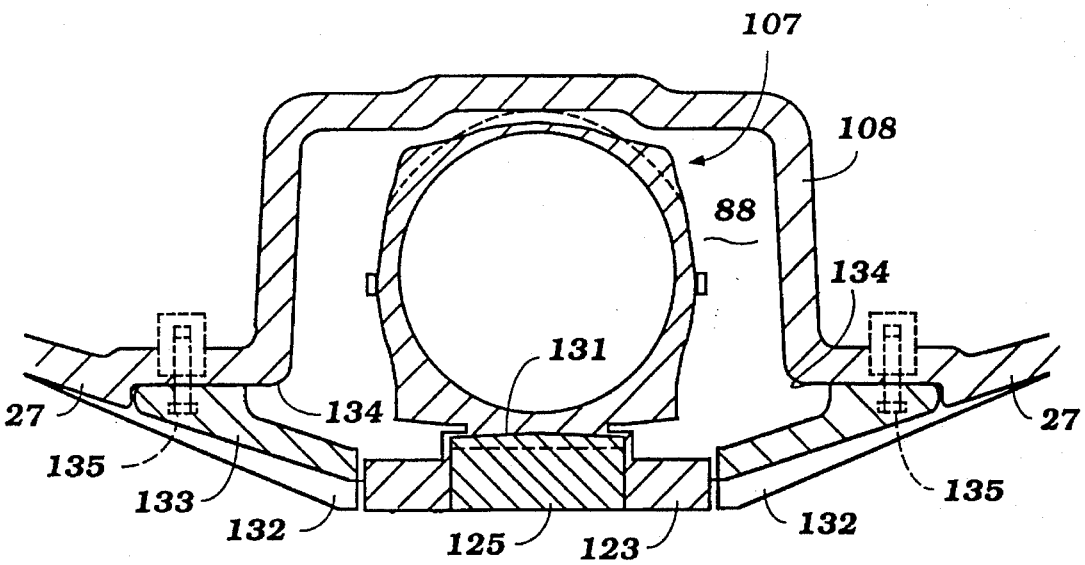
FIG. 6 is an enlarged cross-sectional view taken along the lines 6—6 in FIGS. 4 and 5.
Figure 7:
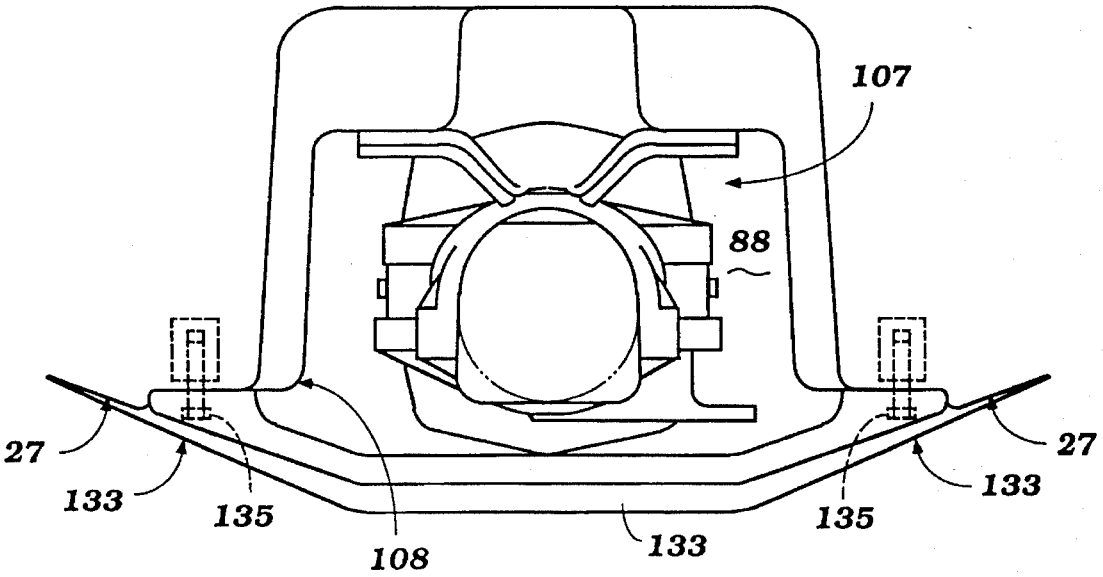
FIG. 7 is a rear elevational view of the area shown in FIG. 6 and is taken generally in the direction of the arrow 7 in FIG. 5.

It should be noted that the rear under-plate 133 is provided with a notched portion 136, into which the front plate 123 extends, but the forward edge of the rear notch 136 is spaced from the rear edge 132 of the plate 123 and the grill-forming member 125 so as to define an air gap 137, which communicates with the tunnel 88, as best shown in FIG. 5. Also, it should be noted that the plate 133 is somewhat higher than the front plate 123 so as to form a step at the surface 132. When the watercraft is traveling at speed, as shown in FIG. 5, air will be drawn by the venturi action caused by the step 132 from the tunnel 88 and mixed with the water, as shown by the arrows 138 in FIG. 5. This has the effect of reducing the drag on the rear portion of the hull, and hence improves the performance of the watercraft.

The jet propulsion unit 107 in addition to being supported by the projection 131 on its underside is supported from above by a carrier 139 (FIG. 7) suitably affixed to the hull wall 108. Thus not all of the weight of the jet propulsion unit 107 is supported by the carrier 139.

It has been noted that the foot areas 38 open through the transom of the watercraft so that persons may enter the watercraft from the body of water in which the watercraft is operating. It should be noted that the raised seat supporting portions 41 and 42 of the deck portion 24 terminate short of the transom of the watercraft, so as to provide a rear deck area, indicated generally by the reference numeral 141. This rear deck area 141 permits a rider to stand to the rear of the seat cushions 44 and 45, and particularly behind the rear seat cushion 45. This standing rider may grip the handgrip 52 of the insert piece 51.

In addition, there is provided a boarding ladder, indicated generally by the reference numeral 142, which is normally stowable in the deck area 141, as shown in FIGS. 1 and 2, but which may be lowered into the body of water in which the watercraft is operating, as shown in the phantom-line view of FIG. 1. The construction of this boarding ladder 142 and its operation will now be described by particular reference to FIGS. 6 and 14–18.

A generally U-shaped supporting frame, indicated generally by the reference numeral 143, is provided that has a pair of long legs 144 that extend longitudinally of the watercraft and a cross leg 145. This frame 143 is mounted in a recess 146 formed on the rear deck 141, centrally thereof and behind the rear seat cushion 45. A pair of lever arms 147 are pivotally connected at one of their ends to a respective one of the frame sides 144 by pivot pins 148. The other ends of the levers 147 are pivotably connected by further pivot pins 149 between respective pairs of lugs 151 formed integrally with a molded plastic ladder element 152. The ladder element 152 is provided with, in the illustrated embodiment, a single step formed by an opening 153 formed therein.

Figure 18:
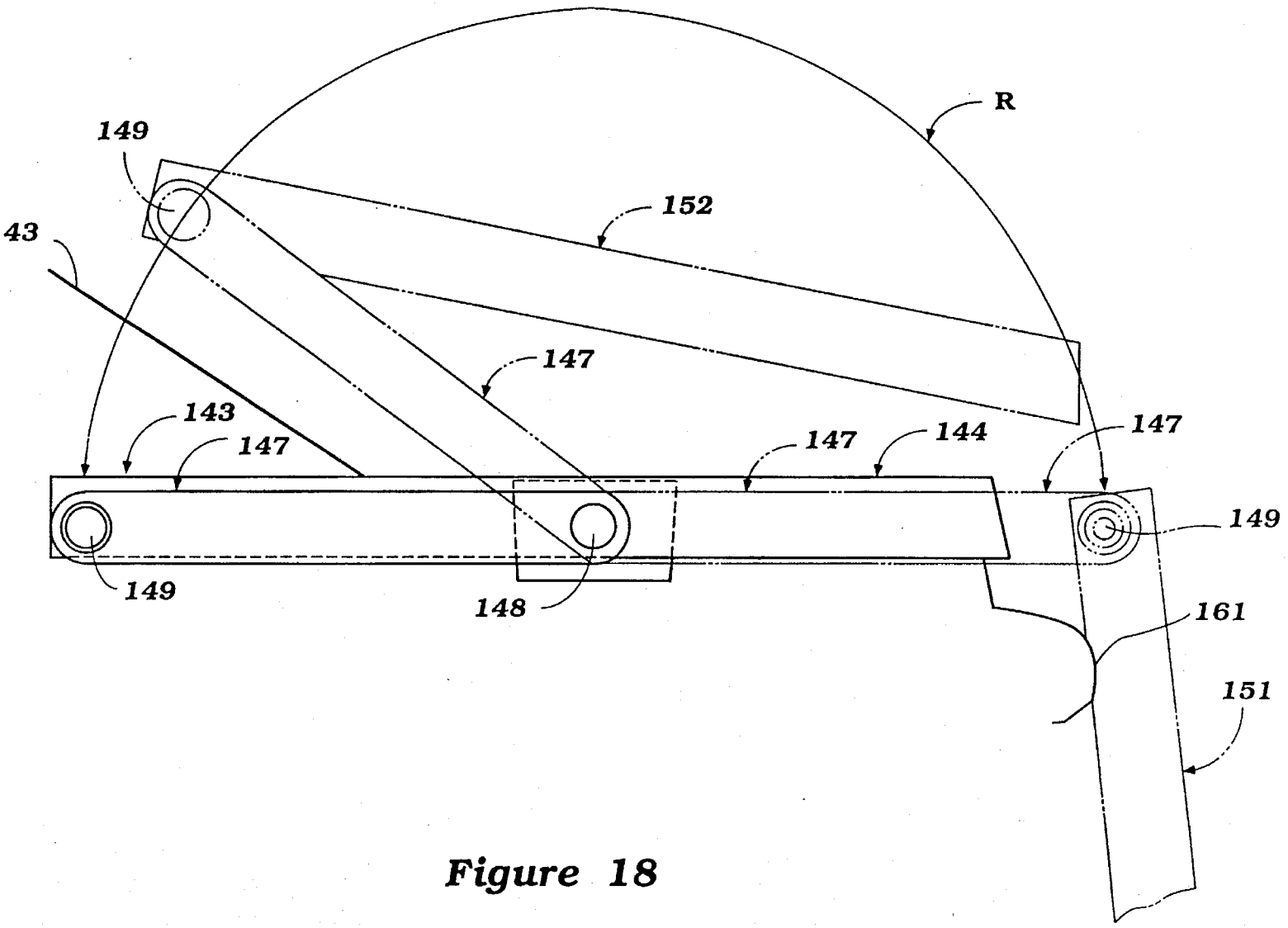
FIG. 18 is a side elevational view showing the supporting mechanism for the boarding ladder and the boarding ladder in its storage position in solid lines and an intermediate and boarding positions in phantom lines.

The sides of the ladder 152 have affixed to them a pair of resilient clips 154 (FIGS. 14 and 16) that are held in place by rivets 158 and that define gaps 159 into which the levers 147 can be releasably retained when the ladder 152 of the ladder assembly 142 is in its storage position. This position is shown in certain of the figures. However, the ladder 152 may be easily pulled upwardly by a rider's placing his hands in the opening 153 and exerting an upward pressure so as to move the ladder from its storage position, as shown in the solid-line view of FIG. 18, to an operative position where it depends over the transom of the watercraft, indicated by the reference numeral 161 in these figures. During this movement the pivot pin 149 moves through the radius R, as shown in FIG. 18. In this position the step of the ladder provided by the opening 153 will be such that a person can grab the handgrip 52 of the insert 51 and easily pull himself from the body of water to enter the deck area 141.

It should be readily apparent from the foregoing description of the preferred embodiment of the invention that the objects set out above are well met by this construction. Of course, the foregoing description is that of the preferred embodiment of the invention, and various changes and modifications may be made without departing from the spirit and scope of the invention, as defined by the appended claims.

I claim:

1. A watercraft comprised of a hull, a rider's area formed by said hull and including an elevated seating portion for accommodating a rider seated therein in straddle position, a pair of foot areas disposed in said rider's area on opposite sides of said elevated seating portion, a propulsion system for said hull and contained at least in part therein, said propulsion system comprising a propulsion device for propelling said hull, an internal combustion engine and a transmission for driving said propulsion device from said internal combustion engine, the upper surface of said elevated seating portion defining an access opening through which at least a portion to said propulsion device may be accessed, and a longitudinally extending seat covering at least a portion of said upper surface, said seat being comprised of a first portion affixed to said hull and spaced from said access opening and a second portion longitudinally spaced from said first portion and detachably connected to said hull and covering and closing said access opening.

2. A watercraft as in claim 1, wherein a control for the longitudinally watercraft is disposed forwardly of the elevated seating portion.

3. A watercraft as in claim 2, wherein the forward most seat portion is the removable portion.

4. A watercraft as in claim 3, wherein the removable seat portion and elevated seating portion carry cooperating sealing surfaces for sealing the access opening when the removable seat portion is detachably affixed to the elevated seating portion.

5. A watercraft as in claim 1, wherein the removable seat portion and elevated seating portion carry cooperating sealing surfaces for sealing the access opening when the seat portion is detachably affixed to the elevated seating portion.

6. A watercraft as in claim 5, wherein the internal combustion engine is disposed at least in part beneath the access opening.

7. A watercraft as in claim 1, wherein the access opening extends longitudinally a lesser distance than the length of the second seat portion.

8. A watercraft as set forth in claim 1, wherein the rearward end of the access opening terminates forwardly of the rearward end of the second seat portion.

9. A watercraft as in claim 2, wherein the seat is adapted to accommodate a pair of riders seated in straddle tandem fashion one on each of the seat portions, the engine being positioned in an engine compartment extending at least in part beneath the forward portion of said elevated seating portion, said engine discharging exhaust gases to an exhaust manifold and from said exhaust manifold to a first expansion chamber device positioned adjacent the engine and beneath said elevated seating portion, exhaust conduit means conveying exhaust gases from said first expansion chamber to a water trap positioned substantially beneath said elevated seating portion, and means for discharging exhaust gases from said watertrap device to the atmosphere.

10. A watercraft as in claim 1, wherein the hull is further provided with a tunnel at the underside thereof and the propulsion device comprises a jet propulsion unit contained within said tunnel and comprised of a downwardly facing water inlet opening portion through which water is drawn by an impeller contained within an impeller portion to the rear of said water inlet portion.

11. A watercraft as in claim 1, wherein the rearward most longitudinal portion of the seat is elevated above the rear portion of said elevated seating portion and further including an insert piece contained between said elevated seating portion and the raised rear portion of said seat, said insert piece providing a grab handle.

* * * * *

UNITED STATES PATENT AND TRADEMARK OFFICE

CERTIFICATE OF CORRECTION

PATENT NO. : 5,619,950
DATED : April 15, 1997
INVENTOR(S) : Keijiroh Ikeda

It is certified that error appears in the above-identified patent and that said Letters Patent is hereby corrected as shown below:

Claim 2,
Line 2, please delete "longitudinally"

Claim 3,
Line 1, please change "the" to -- a --

Claim 7,
Line 2, please change "the length" to -- a length --

Claim 8,
Line 1, please change "the" to -- a --
Line 3, please change "the rearward" to -- a reward --

Claim 9,
Line 5, please change "the" to -- a --

Claim 10,
Line 2, please change "the underside" to -- an underside --.
Line 6, please change "the" to -- a --

Claim 11,
Line 1, please change "the" to -- a --
Line 2, please change "the rear" to -- a rear --

Signed and Sealed this

Twenty-ninth Day of January, 2002

*Attest:*

*Attesting Officer*

JAMES E. ROGAN
*Director of the United States Patent and Trademark Office*